United States Patent [19]

Belleli

[11] 4,342,362

[45] Aug. 3, 1982

[54] COUNTERFLOW HEAT EXCHANGER HAVING TWO FIXED TUBE PLATES

[76] Inventor: Riccardo Belleli, Via Hermada 13, Mantova, Italy

[21] Appl. No.: 25,681

[22] Filed: Mar. 30, 1979

[30] Foreign Application Priority Data

Apr. 6, 1978 [IT] Italy ..... 22067 A/78

[51] Int. Cl.[3] ..... F28F 9/02

[52] U.S. Cl. ..... 165/158; 122/32

[58] Field of Search ..... 165/145, 157, 158; 122/32, 34, 37

[56] References Cited

U.S. PATENT DOCUMENTS

| | | | |
|---|---|---|---|
| 3,279,489 | 6/1966 | Ammon et al. | 122/32 |
| 4,068,627 | 1/1978 | Giesecke | 122/34 |
| 4,157,114 | 6/1979 | Lorenzo | 165/158 |
| 4,198,929 | 4/1980 | Forestier | 122/32 |

FOREIGN PATENT DOCUMENTS

| | | | |
|---|---|---|---|
| 1100242 | 3/1955 | France | 165/158 |

*Primary Examiner*—Samuel Scott
*Assistant Examiner*—Theophil W. Streule, Jr.
*Attorney, Agent, or Firm*—Guido Modiano; Albert Josif

[57] ABSTRACT

A counterflow heat exchanger comprises two upper and lower parallely and coaxially facing tube plates wherebetween extends a tube nest incuding a plurality of tubes connected to the tube plates. Each tube has at one end an U bent over portion and the rectilinear portion of the tube nest, substantially constituting the heat exchange region, is included with an even distribution within an annular interspace defined between an inner jacket and an outer shroud affixed to the tube plates.

7 Claims, 11 Drawing Figures

COUNTERFLOW HEAT EXCHANGER HAVING TWO FIXED TUBE PLATES

BACKGROUND OF THE INVENTION

This invention relates to a counterflow heat exchanger having two fixed tube plates and a thermal exchange region comprising substantially straight tubes, and in particular to a heat exchanger for high pressure high temperature operation suitable for use in conventional and nuclear power stations as well as in other industrial plants.

As is known, many types of industrial plants utilize counterflow heat exchangers which are of considerably large size and, owing to the severe service conditions, to provide reliability of the highest degree, both to avoid the necessity of stopping the plant, which obviously affects the operation economy, and for safety reasons, e.g. steam generators using sodium as the primary fluid which equip nuclear plants of the LMFBR type.

In a majority of cases, such heat exchangers currently comprise a pair of tube plates facing each other and spaced apart from each other, which are interconnected by a tube nest which is welded to the plates, in a manner that will be described hereinafter, for the passage of the secondary fluid therethrough. Also provided is an outer shroud which unites the plates together and encloses the tube nest to confine the region of primary fluid passage. The construction of these exchangers, as well as that of other conventional designs, has first of all the disadvantage—specially evident in the cited steam generators using sodium as the primary fluid—of a non-uniform primary fluid flow at the thermal exchange region, which primary fluid flow is faster at the central portion of its cross-section than at the periphery: this leads to a non-uniform distribution of the wall temperature in the various tubes, with attendant negative consequences, in particular of a mechanical and constructional nature, as the expert will readily recognize.

The primary fluid flow is also imperfectly uniform at the inlet and outlet ends, which comprise conventional annular headers or manifolds, usually located externally to the tube nest.

Known is that in exchangers affording high reliability levels, the best method currently in use for welding the tubes to the tube plates is included among those known as IBW (Internal Bore Welding) procedure, and consists of carrying out a butt weld process in which the tubes are welded to tailpieces purposely formed on the plates with a bore substantially equal to the inside bore of the tubes; more specifically, this type of weld, known per se, contemplates seating of the tube end to be welded in a seat formed on the tailpiece previously formed on the plate, thereafter access is gained, with a welding torch, to the inside of the tube, at the junction area, to perform a weld which usually involves no addition of material.

This type of weld, especially on account of the severe operating conditions of the exchanger types mentioned above, must be then checked individually, generally by X-ray, to ascertain the reliability thereof. Now, in a majority of the conventional heat exchangers, as mentioned above, the tube plates are arranged to face each other at a distance apart, thereby it is necessary, for permitting insertion of the individual tubes constituting the nest in conformity with the necessary manufacturing and control procedures, to provide in one plate bores of substantially the same size as the tube outside diameter, whereas on the other plate it is possible to prearrange the tailpieces with seats adapted for accomodating the type of weld just described.

A serious drawback with conventional exchangers is that bores must be formed in a plate which have the same size, or slightly larger size, as the tube outside diameter, thereby it becomes necessary to hold the tube end a few millimeters inside the bore, suitably made oversize to permit the tube passage; consequently when the weld is performed of this end of the tube to the tube plate, the weld area is not rectilinear but is of necessity forced to assume a flared shape of substantially truncated cone pattern.

The presence of this flare at the weld areas has first of all the drawback of undergoing flex and shear actions, technically undesired in this type of joint, and moreover this type of weld is difficult to radiograph, thereby considerable problems are created for the control step; technical problems may also originate from the fluid dynamic characteristics involved.

Another serious drawback of the heat exchangers of the type mentioned above is that, for obvious construction and control reasons, at least part of the outer shroud must be applied to the plates after welding the tube nest of the plates, thereby considerable difficultly is encountered in radiographing the shroud welds, while it is impossible to reweld, owing to the lack of accessibility from the inside. It should be added to the above that connecting the shroud to the tube plates after the application of the tube nest is an operation which makes the heat treatment of the welded areas of the shroud extremely difficult to carry out.

In the heat exchangers of the type just described an expansion joint may be provided on the shround or skirt to allow for thermal expansion differentials between the tube nest and shroud; although in this case there exists a chance of the whole tube nest expanding, any expansion differentials between single tubes are prevented, as may result from various causes, among which a different distribution of the flow from one tube to the other. These expansion differentials unavoidably generate tensions which concentrate at the weld areas between the tubes and tube plates, with obvious danger and inconvenience, mainly at the conventional joints, wherein as described flex and shear efforts are generated.

A further drawback of almost all of the known types, and specially felt when high pressures are involved, resides in that the forged stock used in forming the tube plates has a considerably high mass, with all its attendant complications of a mechanical, thermal and metallurgical nature; also substantial are the difficulties of assembling the tube nest.

SUMMARY OF THE INVENTION

Therefore, this invention sets out to provide a counterflow heat exchanger having two fixed tube plates, the thermal exchange region whereof comprises substantially straight tubes, which is so constructed as to permit the application, at both ends of the tube nest, of IBW butt weld connections to tailpieces formed on both tube plates, with a bore of substantially the same diameter as the tube inside diameter.

A further object of the invention is to provide a heat exchanger which, while having both the tube plates fixed, allows for a differential expansion of the tubes in the tube nest, and above all such differential expansion among the tubes to occur substantially without inducing flexural and shearing stresses in any of the two welds joining each tube to the tube plates.

Another object of the invention is to provide welded regions both between the tubes and the plates, and between the outer shroud and the plates, which can be conveniently checked on X-ray equipment, and, as relates to the weld of the tubes to the plates, to also make ultrasonic inspection convenient, thus to achieve the most complete and high reliability levels.

Yet another object of the invention, is to provide a heat exchanger, wherein the tubes through which the secondary fluid is circulated are distributed in a polar symmetry type of arrangement, namely a symmetry situation which is substantially the same with respect to all of the planes making up the star about the longitudinal axis of the heat exchanger, or in other words with a uniform distribution arrangement over an annulus, such that said tubes are uniformly subjected to the primary fluid flow: a first advantage of the above arrangement of the tubes is that the circulation of the primary fluid through a duct annulus-like cross-section occurs with an improved distribution over that obtained in conventional exchangers where said fluid flow section occupies the entire circular cross-section of the exchanger, to result in uneveness between the central region and the regions closer to the walls; moreover, a polar symmetry distribution of the thermal gradients through the exchanger structural members is achieved, thus attaining a condition of substantial equality in the distribution of the temperature levels for each axial section, with obvious and very important advantages as relates to the distribution of the consequential mechanical stresses through said members.

It is another object of the invention to achieve optimal uniformity in the flow of the primary fluid at the inlet and outlet ends of the tube nest, by means of a structure which is simpler than the one currently employed and comprising annular manifolds, usually on the outside of the tube nest.

Yet another object of the invention is to provide a structure wherein all of the tube-to-tube plate weld regions are only subjected to compressive or tensile stresses, with the advantage that undesirable flexure and shear stresses are eliminated. Furthermore, probes become easy to insert for periodically checking the welds of the tubes to the tube plates, without requiring prior disassembly of the apparatus, which is a time and labor consuming operation, and accordingly an expensive one.

This invention is also directed to utilizing, for the tube plate construction, forgings of reduced mass, because this affords several additional advantages: first of all the achievability of a good quality level in the mechanical properties of the material, which is instead difficult to obtain when large mass forgings must be used, as is the case with most of the known types. Specially useful is also the use of reduced mass forgings and small thickness dimensions, when the operating conditions typically involve strong thermal gradients between the primary and secondary fluids, by particularly rapid thermal transients, and when the primary fluid has a high thermal conductivity, which conditions may all be found, for example, in the steam generators which employ sodium for the primary fluid.

These and other objects, such as will be apparent hereinafter, are achieved by a counterflow heat exchanger having two fixed tube plates, according to this invention, characterized in that it comprises an upper tube plate and lower tube plate, said plates being arranged to face each other and parallel and coaxial to each other, and having bored areas of different mean diameters, between said upper and lower tube plates there extending a tube nest including a plurality of tubes connected to said tube plates and arranged in substantially polar symmetry, each of said tubes having at one end an U bent over portion, the rectilinear portion of said tube nest, substantially constituting the heat exchange region, being included with a substantially uniform distribution within an annular interspace defined between an inner jacket and outer shroud affixed to said tube plates.

BRIEF DESCRIPTION OF THE DRAWINGS

Further features and advantages will be more clearly understood by making reference to the following description of two preferred, though not limitative, embodiments of a counterflow heat exchanger having two fixed tube plates and being suitable for application, e.g. as the steam generator of nuclear power stations employing liquid sodium for the primary fluid, which are illustrated by way of example only in the accompanying drawings, where.

DESCRIPTION OF A PREFERRED EMBODIMENT

Figure 1:
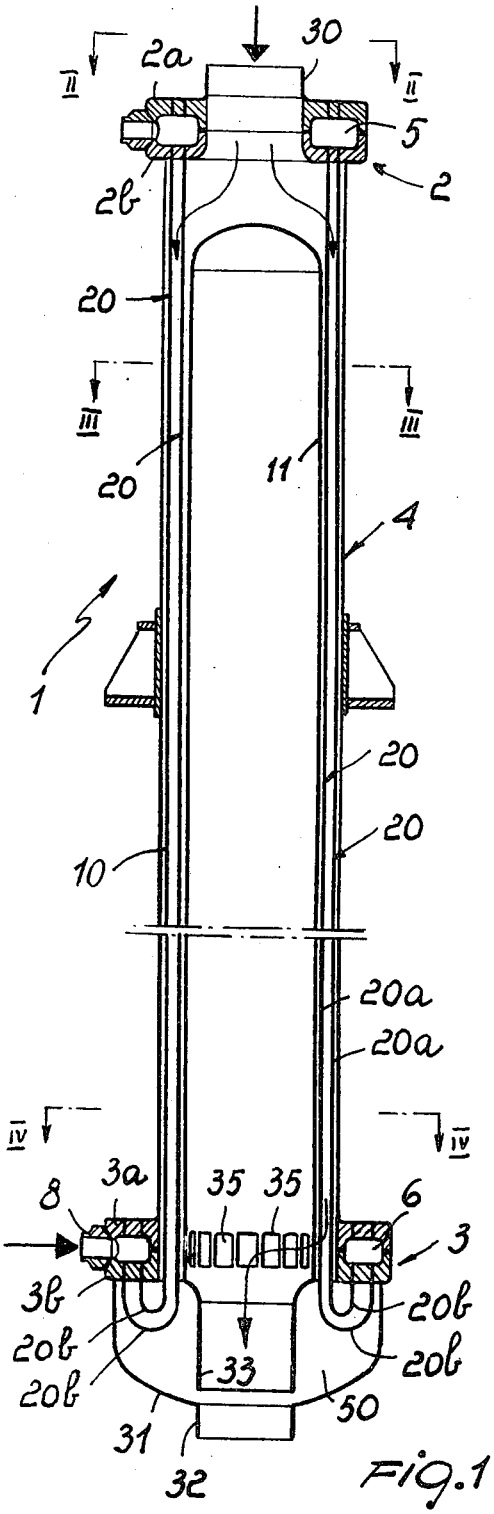
FIG. 1 shows schematically in longitudinal section the heat exchanger according to this invention.
Figure 2:
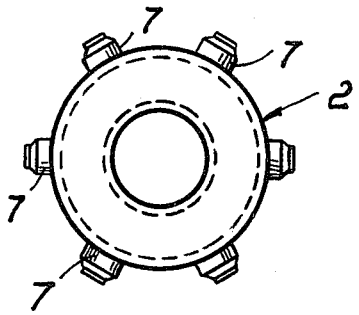
FIG. 2 is a view taken along the line II—II of FIG. 1.
Figure 3:
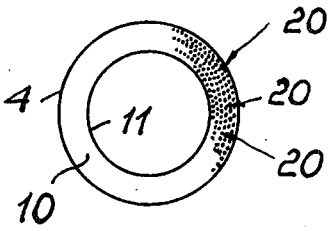
FIG. 3 is a schematical sectional view taken along the line III—III of FIG. 1.
Figure 4:
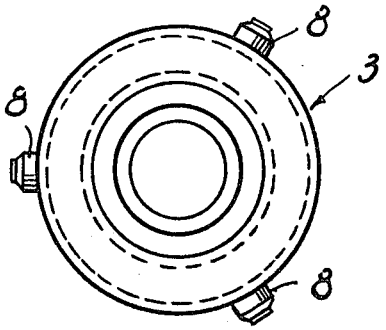
FIG. 4 is a sectional view taken along the line IV—IV of FIG. 1.
Figure 5:
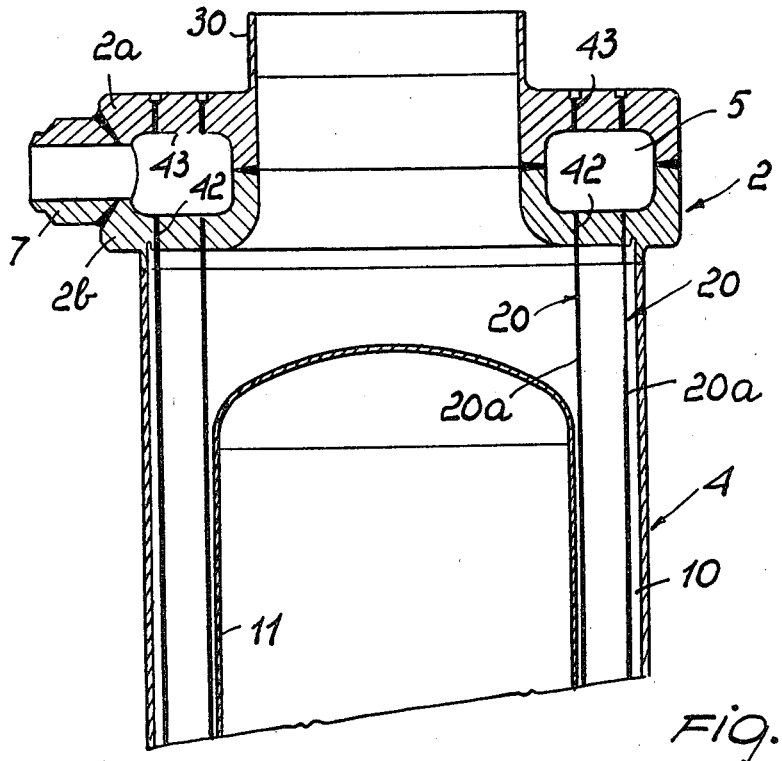
FIG. 5 is a schematical enlarged scale detail view of the upper tube plate.
Figure 6:
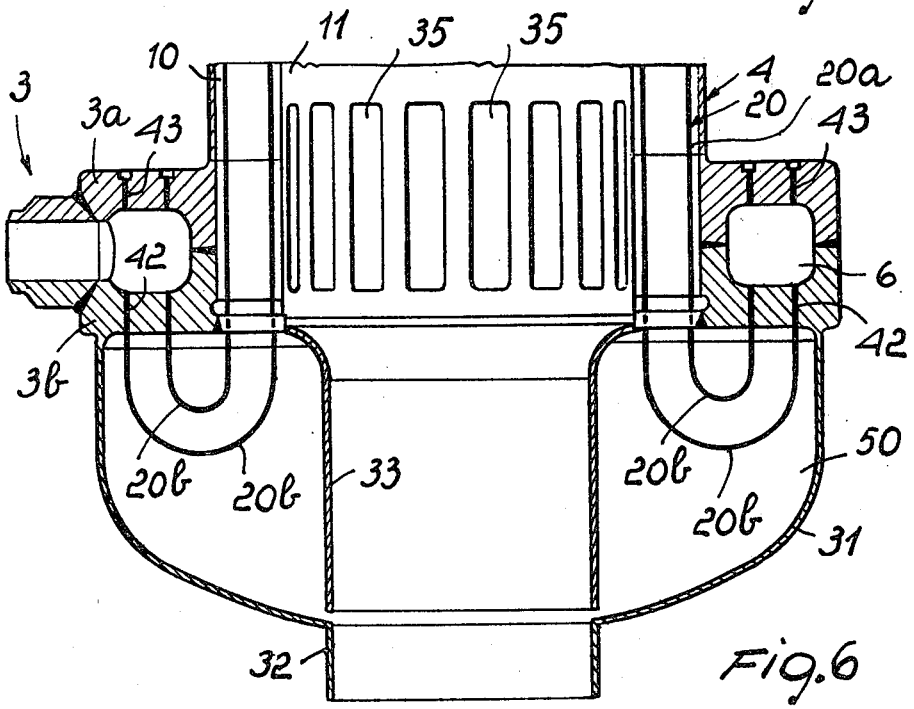
FIG. 6 shows schematically, to an enlarged scale, a detail of the lower tube plate.
Figure 8:
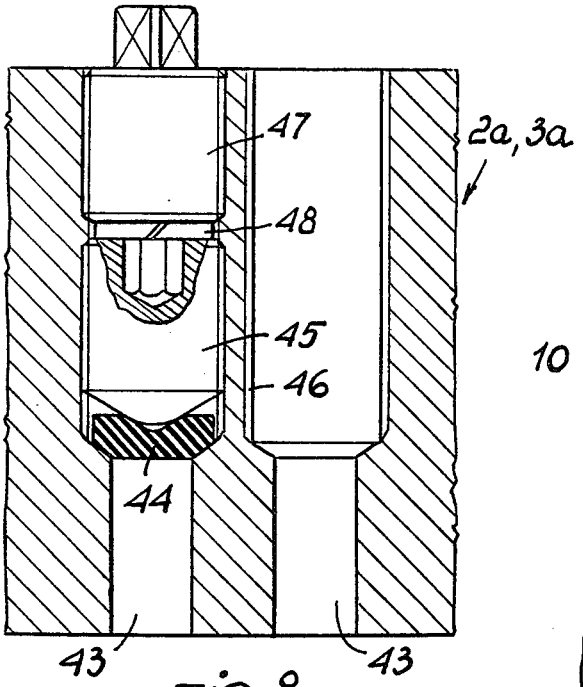
FIG. 8 is a sectional view of a detail of the safety plugs mounted in the bores formed in the tube plates at the tubes.
Figure 7:
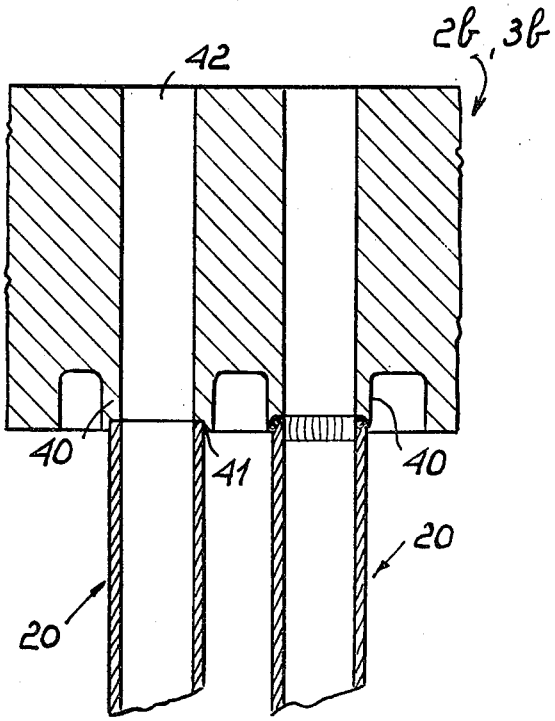
FIG. 7 illustrates schematically and in section the weldment regions of the tube nest tubes to the tube plates.

With reference to FIGS. 1 to 9, the counterflow heat exchanger 1 with two fixed tube plates, according to the invention, comprises an upper or top tube plate, generally indicated at 2, and a lower or bottom tube plate, generally indicated at 3. Said tube plates 2 and 3 have an annular configuration and are arranged to face each other concentrically at a distance apart; furthermore, the plate 3 has of preference a larger diameter than the plate 2.

Said plates 2 and 3 are joined to each other by an outer shroud 4 of substantially cylindrical shape, which may be provided at a middle portion of its longitudinal extension with a thermal expansion joint, not shown in the drawings. Said outer shroud 4 is welded to the plates 2 and 3 prior to the insertion of the tube nest, thereby it is possible to fully inspect the completed welds, as well as to apply reverse welding or back welding thereto, to achieve certainty of a properly carried out job.

It should be added to the above that, since the diameter of the plate 3 is larger than the plate 2, the outer shroud 4 is welded at the inner opening of the plate 3, which plate is thus located practically oustide of the shroud 4.

More specifically, the plates 2 and 3 define respectively, at their inside, an upper annular chamber 5 and lower annular chamber 6. The upper tube plate 2 comprises an upper body *2a* which is welded to a lower body *2b*, thereby to define the cited chamber 5, which acts in practice as an outlet manifold and is provided radially with a plurality of outlet connectors as indicated at 7, which are evenly distributed with respect to the upper annular manifold tube plate 2.

The lower tube plate 3 is also made up of an upper body indicated at *3a* and lower body indicated at *3b*, which are welded to each other such as to define the cited lower annular chamber, in practice acting as an inlet manifold and communicating to a plurality of inlet connectors or fittings 8, also evenly distributed.

The cited chambers 5 and 6 are united together by a tube nest which is accomodated in an annular interspace 10 defined between the cited outer shroud 4 and an inner jacket 11, arranged coaxially with the shroud 4 and having a substantially cylindrical configuration closed at the top.

The cited tube nest, and here is an essential feature of the invention, comprises a plurality of uniformly distributed tubes indicated at 20, which have a rectilinear portion *20a*, located inside said interspace 10, and at one end, specifically the end next to the plate 3, an U bent over portion *20b*. The cited U bent over portions *20b* extend preferably in a raidal plane with respect to the exchanger longitudinal axis, and are inserted with their free ends into the lower tube plate 3, which is purposely provided with a larger diameter than the upper plate 2.

Before discussing in detail the connections of the tubes 20 of the tube nest to the plates 2 and 3, it should be noted that the outer shroud 4 includes an inlet mouth 30 arranged towards the top in the axial direction and accomodated in practice within the upper plate 2, while at the bottom a closing cap 31 is provided which is connected to the plate 3 and encircles the same externally, said cap having an outlet mouth 32, also axially arranged. Furthermore, the cited jacket 11 has at its bottom end a fitting 33 positioned in alignment relationship with the cited outlet mouth 32. Close to said fitting 33 on the jacket 11, a plurality of windows 35 are provided which serve for conveying the primary fluid admitted through the inlet mouth 30 and passed through the interspace 10 within the jacket 11 to direct it to the discharge end.

As visible from the drawing, the outer diameter of the jacket 11 is greater than the diameter of the mouth or opening 30, while the diameter of the latter is greater than the difference between the inner diameter of the shroud 4 and the outer diameter of the jacket.

The connection of the tubes 20 to the respective plates 2 and 3 is implemented by welding in conformity with the known IBW (Internal Bore Welding) procedure of the TIG (Tungsten Inert Gas) type. An essential feature is that with the structure just described the ends of the tubes 20 can be connected in the same manner to both the upper plate 2 and lower plate 3, since it is no longer necessary, as is instead required in conventional designs, to provide a larger diameter bore, i.e. one having a diameter substantially equal to the tube outside diameter, both tube plates, upper and lower, being adapted for providing tailpieces 40 with annular seats 41 wherein the ends of the tubes 20 are inserted.

More specifically, the cited tailpieces 40 are formed on the lower bodies *2b* and *3b* of the respective plates 2 and 3. At each tailpiece 40, a bore 42 is provided which puts the tube 20 in communication with the inside of the respective annular chamber 5 or 6, and which has an inside diameter substantially equal to the inside diameter of each tube 20. Moreover, at each bore 42 in the lower body *2b* or *3b*, there corresponds in the upper body *2a* or *3a* a through bore 43 aligned with the bore 42 and serving the function of permitting access for the torches which will perform the welding of the tube 20 to the respective tailpiece 40.

Each through bore 43 is closed removably by a closing plug formed of a seal member 44 which is compressed by a threaded rod 45 which engages with a threaded portion 46 provided at the free end of the through bore 43, whereto a safety threaded rod 47 also engages, with the interposition of a spring lockwasher 48.

This embodiment affords the possibility of removing the closures of the various through bores 43 to provide access for periodical inspection of the tubes and checking of the welded regions.

From the foregoing, it will be apparent that a fundamental feature of the instant heat exchanger is that, by providing substantially rectilinear tubes in the area of thermal exchange, which tubes have an U bent over end portion, it becomes possible to make in a completely similar manner and with the best of methods the connecting welds to both the lower plate and upper plate, thus achieving the advantage of uniform welds which can be easily inspected and X-rayed.

Another no less important feature is that, by having the tubes formed with an U bent over end portion, the expansion occurring in the tubes can be accomodated and above all any differential expansion released, i.e. different expansions from one tube to another as due to differences in the thermal distribution, without such expansion rates generating stresses in the welded regions.

Furthermore, the use of tubes having an U bent over portion and being all butt welded to the tube plates affords the advantage that the welds are only moderately stressed and substantially exclusively by tension or compression, namely stresses that are more acceptable for the weld and such as not to induce technically undesirable strains.

It should be further added to the above that the cited U bent over portion has its end welded to the lower body of the tube plate 3 at a distance from the location of intercommunication between the annular chamber 6 and bore 42, and this is of considerable import in that the fluid flow streamlines in changing their direction owing to their passing from the annular chamber 6 to the bores 42 opening towards the tubes 20, tend to create cavitation areas at their location of directional change, which areas, if positioned at the welds, would result in premature damage to the welded regions. By contrast, in the example considered, it may be seen that the welded region of the free end of the U bent over portion 20*b* of each tube 20 happens to be spaced apart from the connection area of the bores 42 to the annular chamber 6; this causes the fluid flow streamlines to achieve a stable pattern by the time they move past the welded region, thereby no undesired erosion is produced at the region of the weld between the tubes and lower tube plate.

Another feature of the invention is that the cited U bent over portions of the tubes is arranged at an annular area 50 which, as mentioned hereinabove, is defined by the cap 31 and inlet fitting 33, and defines in practice a part of the primary fluid circuit wherein the fluid is virtually stagnant and induces no vibratory state in the U bent over portions 20*b* of the tubes 20.

It is also pointed out that a feature of the invention resides in the use of low mass small thickness forgings for the construction of the tube plates, with obvious attendant advantages.

The invention is further characterized in that it provides an axial flow inlet and outlet for the primary fluid, an approach this one that affords simplicity of installation, reduced costs, an optimal fluidodynamic distribution of the fluid, and easy draining in the event of failure.

Figure 9:
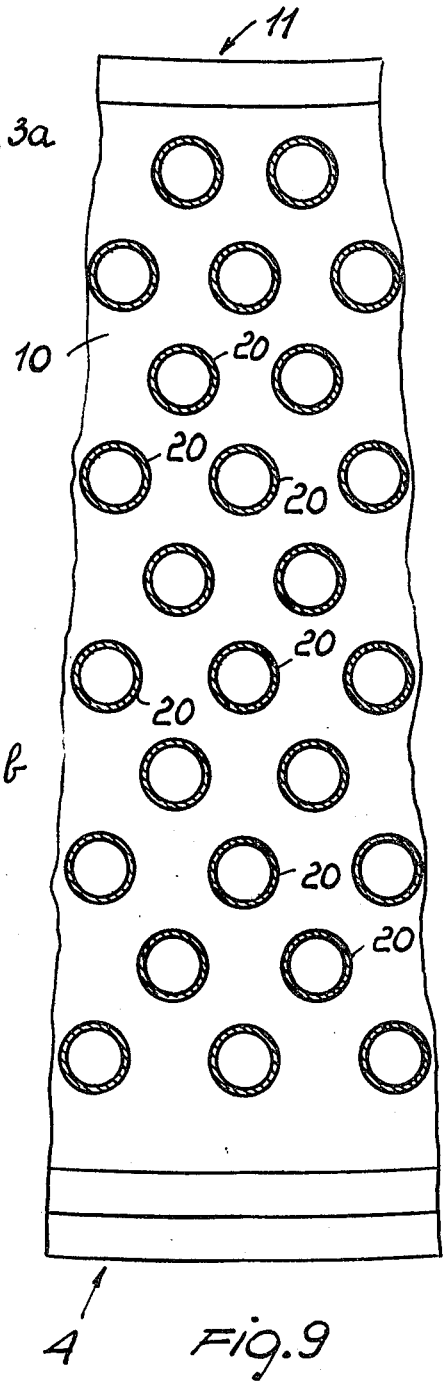
FIG. 9 is an enlarged scale cross-sectional view of part of the tube nest.

To conclude with, it is pointed out that in the accompanying drawing figures, for clarity and simplicity of illustration, there are only shown those inner and outer tubes of the tube nest, which actually border the arrangement of the tubes 20; in actual practice, and as made clear in FIG. 9, there are provided a plurality of such tubes 20, uniformly distributed with respect to one another and accomodated in the annular area 10.

The heat exchanger according to this invention is operated in the following manner. When using the exchanger in the counterflow mode, the primary fluid, which is for example at a temperature of some 500° C. and pressure of 10 atmospheres, is admitted through the inlet mouth 30 to the inside of the exchanger in such a way as to strike the tubes 20 of the tube nest located in the interspace 10; said primary fluid flows lengthwise through the interspace 10 to transfer heat to each tube 20, thereafter it flows to the outlet mouth through the windows 35. Simultaneously, the secondary fluid, i.e. the fluid to be heated, is admitted to the lower annular chamber 6 through the inlet connections 8 and conveyed to the tubes 20 after flowing initially, as already mentioned, through the U bent over portion 20*b*, and then through the straight portion 20*a*, where the thermal exchange takes place.

At the end of the straight or rectilinear portion 20*a*, the secondary fluid is admitted to the upper annular chamber 5 wherefrom, through the outlet connections 7, it is removed from the heat exchanger.

Understandably, even though in the above description reference has been made to a counterflow operation of the primary fluid relative to the secondary fluid, nothing would change design-wise in the event of the exchanger being operated in uniflow mode, as nothing would change if counterflow operation were carried out with the flow direction of the two fluids, primary and secondary, reversed.

It will be appreciated from the foregoing that the invention achieves its objects, and in particular it should be underlined that the instant structure allows for a construction resulting from a procedure which is simple and permits checking of the welds to be easily carried out. After assembling the tube plates 2 and 3 to the shroud 4 and in the absence of the closure cap 31, those tubes 20 are first inserted which lay closer to the shroud 4; after welding said tubes in the manner described above, without any necessity of changing the exchanger position, one can conveniently proceed with the visual and X-ray inspection of the welds formed: for the weld in the plate 3, access is had from the outside, since, it will be remembered, the cap 31 is not yet in place, while for the plate 2, access is gained from the inside through the passage 30. The rest of the tubes are mounted in succession from the shroud 4 towards the inside such as to have at all times free access to the welds.

Figure 10:
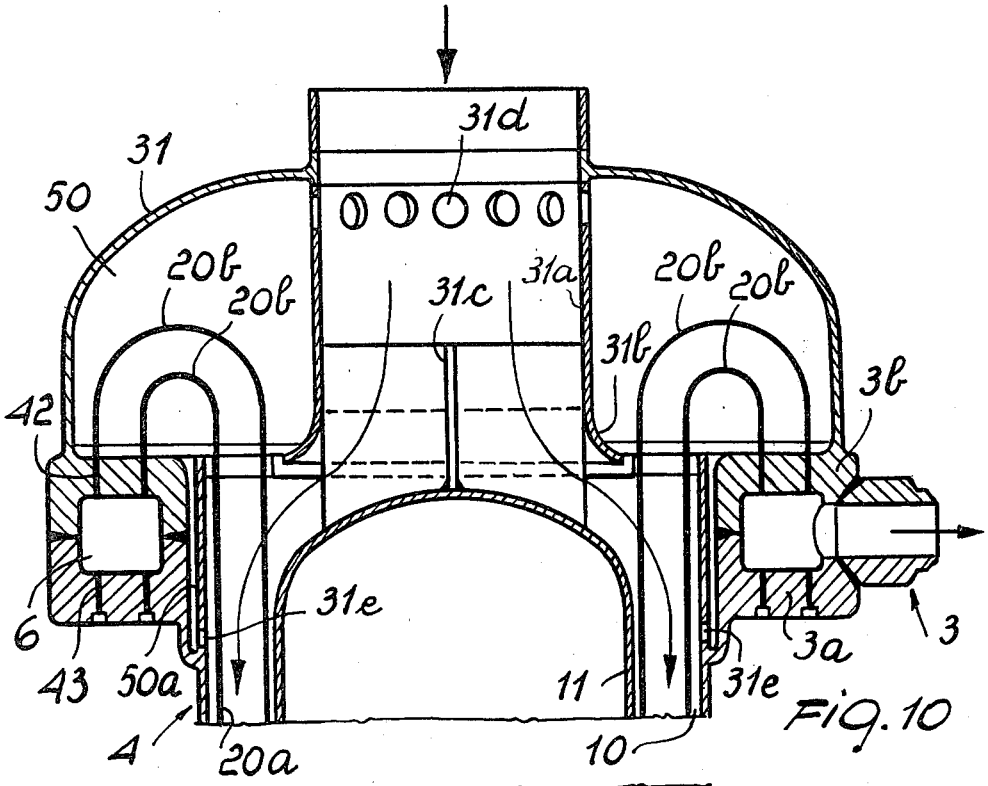
FIG. 10 shows schematically a detail of the upper tube plate according to a variation of the invention wherein, moreover, the heat exchanger is arranged upside down.
Figure 11:
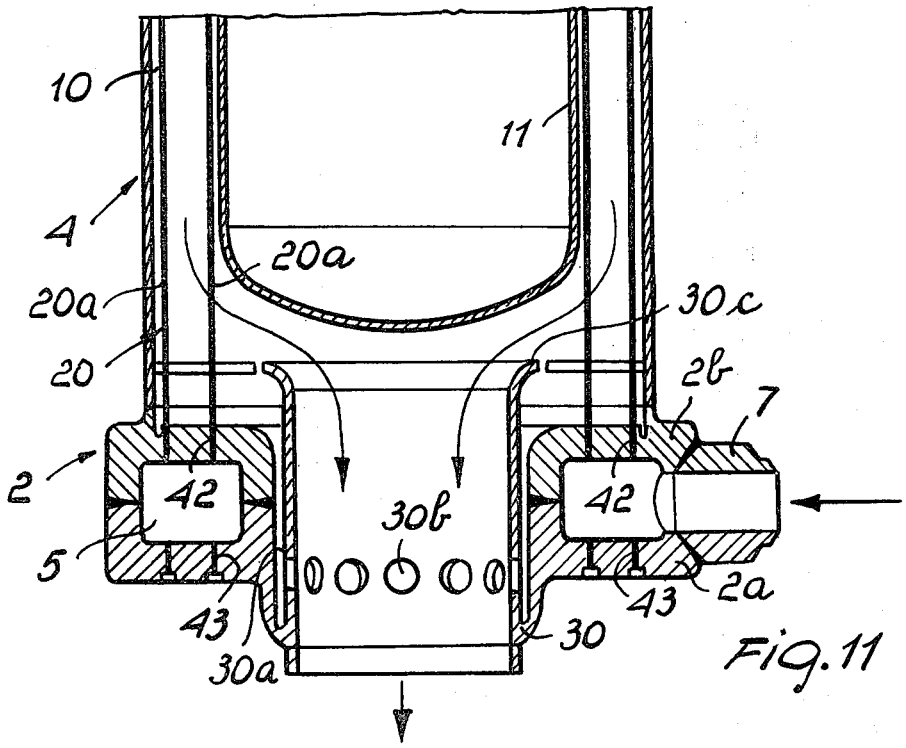
FIG. 11 shows schematically a detail view of the lower tube plate according to a variation of the invention wherein the heat exchanger is arranged upside down.

FIGS. 10 and 11 illustrate respectively the inlet and outlet ducts for the primary fluid according to a variation of the invention wherein furthermore the heat exchanger is positioned upside down. In this variation, the outlet duct for the primary fluid 30 is connected to the tube plate 2 and inserted into the ring defined by the same to form an interspace 30*a* which functions as a thermal shield and inside which a limited flow of primary fluid is allowed by the openings 30*b;* the top or upper end 30*c* of the duct 30 is flared out to facilitate the primary fluid flow in the direction of the arrows shown in the Figure, for an optimal lead in of the same.

At the inlet, the primary fluid is directed, as indicated by the arrows in Figure, to the duct 31*a* which branches axially off the closure cap 31 to present the flare 31*b* such as to lead the flow of said fluid; to said duct 31*a* is connected the inner jacket 11 by means of ribs as indicated at 31*c*. A limited flow of primary fluid is ensured by the openings 31*d* and 31*e* through the area 50, defined by the duct 31*a* and cap 31, and through the area 50*a* which is defined between the tube plate 3 and the extension of the shroud 4, acting as a thermal shield.

The invention as described is susceptible to many modifications and variations, all of which are intended to fall within the scope of the instant inventive concept. In particular, the upper tube plate of FIG. 1 may comprise a disk formed with an axial hole for access during the manufacturing and checking steps, which is intended to be closed by a welded structural member, and cap complete with an axial outlet duct which is welded to the opposite side from the tube nest for collecting the secondary fluid, the inlet for the primary fluid being provided through suitable connections formed on the shroud in the proximity of said tube plate.

Furthermore, the fluid flows could be reversed.

In practicing the invention, all of the details may be replaced with other technically equivalent elements.

In actual practice, the material employed, as well as the shapes and dimensions, may be any ones to suit the application requirements.

I claim:

1. A heat exchanger with a longitudinal extension having a cylindrical outer shroud coaxial and substantially coextensive therewith, an inner cylindrical jecket closed at least at one end thereof and spaced from said outer shroud thereby to define therebetween a cross-sectionally annular interspace, a first annular tube plate at one end of said cylindrical shroud coaxial therewith and a second annular tube plate at the other end thereof and coaxial therewith, means defining a first opening for a first heat exchanging fluid at said one end of said cylindrical shroud coaxial therewith an surrounded by said first annular tube plate and in communication with said annular interspace, means defining a second opening for said first heat exchanging fluid at said other end of said shroud coaxial therewith and surrounded by said second tube plate and in communication with said annular interspace, said second tube plate having a mean diameter greater than the mean diameter of said first tube plate, first wall means in said first tube plate defining one annular collector chamber therein coaxial therewith, said first wall means including one annular flat surface internal to said outer shroud and facing said annular interspace in the longitudinal direction of the heat exchanger towards said other end, a first plurality of through holes distributed all over said one annular flat surface and opening into said one annular collector chamber, second wall means in said second tube plate defining another annular collector chamber therein coaxial therewith, said second wall means including another annular flat surface having a mean diameter greater than the diameter of said outer shroud and facing away therefrom in the longitudinal direction of the heat exchanger and extending in a plane parallel to said one annular flat surface, a second plurality of through holes distributed all over said another annular flat surface and opening into said another annular collector chamber, said means defining a second opening including a cap enclosing said another annular flat surface, said second plurality of through holes being circumferentially and outwardly offset with respect to said first plurality of through holes, said one and said another collector chambers having connectors for a second heat exchanging fluid to circulate therethrough, a plurality of substantially rectilinear parallel heat exchanger tubes within said annular interspace and extending in the longitudinal direction of the heat exchanger and coextensive with said annular interspace and arranged therein in substantially polar simmetry, said tubes having their one straight end thereof terminating in said first plurality of holes to allow circulation of said second heat exchanging fluid between said one collector chamber and said heat exchanger tubes, said tubes having on the opposite side thereof end portions U-bent outwardly with respect to said annular interspace and having their edges terminating at said second plurality of holes to allow circulation of said second heat exchanging fluid between said another collector chamber and said heat exchanger tubes.

2. A heat exchanger with a longitudinal extension having a cylindrical outer shroud coaxial and substantially coextensive therewith, an inner cylindrical jacket closed at least at one end thereof and spaced from said outer shroud thereby to define therebetween a cross-sectionally annular interspace, a first annular tube plate at one end of said cylindrical shroud coaxial therewith and a second annular tube plate at the other end thereof and coaxial therewith, means defining a first opening for a first heat exchanging fluid at said one end of said cylindrical shroud coaxial therewith and surrounded by said first annular tube plate and in communication with said annular interspace, the outer diameter of said jacket being greater than the diameter of said first opening, the diameter of said first opening being greater than the difference between said inner diameter of said shroud and the outer diameter of said jacket thereby to allow easy access through said opening towards said first tube plate, means defining a second opening for said first heat exchanging fluid at said other end of said shroud coaxial therewith and surrounded by said second tube plate and in communication with said annular interspace, said inner jacket having a closure element at the end thereof nearest to said first tube plate to prevent fluid passage there through, and at the opposite end thereof near said second tube plate said jacket having windows in the peripheral surface thereof and a mouth coaxial with said second opening to allow passage of fluid therethrough, said second tube plate having a mean diameter greater than the mean diameter of said first tube plate, first wall means in said first tube plate defining one annular collector chamber therein coaxial therewith, said first wall means including one annular flat surface internal to said outer shroud and facing said annular interspace in the longitudinal direction of the heat exchanger towards said other end, a first plurality of through holes distributed all over said one annular flat surface and opening into said one annular collector chamber, second wall means in said second tube plate defining another annular collector chamber therein coaxial therewith, said second wall means including another annular flat surface having a mean diameter greater than the diameter of said outer shroud and facing away therefrom in the longitudinal direction of said heat exchanger and extending in a plane parallel to said one annular flat surface, a second plurality of through holes distributed all over said another annular flat surface and opening into said another annular collector chamber, said means defining a second opening including a cap enclosing said another annular flat surface and defining a stagnation space therearound for maintaining therein said first heat exchanging fluid substantially stagnant, said second plurality of through holes being circumferentially and outwardly offset with respect to said first plurality of through holes, said one and said another collector chambers having connectors for a second heat exchanging fluid to circulate therethrough, a plurality of substantially rectilinear parallel heat exchanger tubes within said annular interspace and extending in the longitudinal direction of the heat exchanger and coextensive with said annular interspace and arranged therein in substantially polar symmetry, said tubes having their one straight end thereof terminating in said first plurality of holes and butt welded thereto to allow circulation of said second heat exchanging fluid between said one collector chamber and said heat exchanger tubes, said tubes having on the opposite side thereof end portions located within said stagnation space and U-bent outwardly with respect to said outer shroud and having their edges terminating at said second plurality of holes and butt welded thereto to allow circulation of said second heat exchanging fluid between said another collector chamber and said heat exchanger tubes.

3. A heat exchanger according to claim 1 wherein said inner jacket has both its ends closed and wherein said means defining said second opening comprise one duct intersecting and extending through said cap coaxial with said jacket and having one flared formation at the end thereof facing the adjacent closed end of said jacket thereby defining one annular passageway between said one flared formation and the adjacent closed end of the jacket thereby allowing an even distribution of said first heat exchanging fluid in relation to said annular interspace.

4. A heat exchanger according to claim 3, wherein said one duct has a peripheral portion thereof including bores circumferentially distributed thereover in a position intermediate said one flared formation and the intersection with said cap to allow moderate flow therethrough of said first heat exchanging fluid.

5. A heat exchanger according to claim 1 or 2, wherein said means defining said first opening comprise a first duct surrounded by said first annular tube plate and circumferentially spaced therefrom to define a heat insulating annular gap therebetween, said first duct having a first flared formation at the end thereof facing the proximate closed end of said jacket thereby defining another annular passageway between said first flared formation and the proximate closed end of said jacket thereby allowing an even distribution of said first heat exchanging fluid in relation to said annular interspace, said first duct having a peripheral rim formation located longitudinally and externally beyond said first tube plate and said tube plate having a tubular extension coaxial therewith on the side thereof facing said peripheral rim formation and connected therewith thereby to support said first duct formation and thereby said heat insulating annular gap extending over the entire longitudinal extension of said first tube plate, said first duct including circumferentially distributed perforations in a position intermediate said first flared formation and said peripheral rim formation thereby to allow moderate flow therethrough of said first heat exchanging fluid.

6. A heat exchanger according to claims 1 or 2, wherein said first wall means have one annular wall portion on the side of said first tube plate opposite to said one annular flat surface and facing said first plurality of through holes, first inspection through bores in said one annular wall portion, each whereof being aligned with a corresponding through hole of said first plurality of through holes, a removable closing plug in each of said first inspection through bores, said second wall means having another annular wall portion on the side of said second tube plate opposite to said another annular flat surface and facing said second plurality of through holes, second inspection through bores in said another wall portion, each whereof being aligned with a corresponding through hole of said second plurality of through holes, a further removable closing plug in each of said second inspection through holes.

7. A heat according to claim 6, wherein said inspection bores have an internally threaded end portion with an enlarged diameter for receiving therein said closing plug, said plug having threads in screwing engagement with the internal thread of said bore end portion, a sealing member on the bottom of said enlarged diameter bore portion normally pressed thereagainst by said closing plug, a spring lockwasher on said plug and a threaded safety screw member urging said lockwasher against said plug to lock it in position.

* * * * *